United States Patent [19]

Davies

[11] 4,157,526

[45] Jun. 5, 1979

[54] MULTI-STAGE HEAT SENSING CABLE AND EMERGENCY COMMUNICATION SYSTEM

[76] Inventor: John S. Davies, 1010 Norumbega Dr., Monrovia, Calif. 91016

[21] Appl. No.: 770,673

[22] Filed: Feb. 22, 1977

[51] Int. Cl.[2] ..... H01H 37/76

[52] U.S. Cl. ..... 337/415; 340/596

[58] Field of Search ..... 337/415; 340/227 C; 174/113

[56] References Cited

U.S. PATENT DOCUMENTS

| | | | |
|---|---|---|---|
| 673,903 | 5/1901 | Gould | 337/415 |
| 2,185,944 | 1/1940 | Holmes | 337/415 |
| 2,755,363 | 7/1956 | Pryor | 340/227 C |
| 3,257,530 | 6/1966 | Davies | 337/415 |

FOREIGN PATENT DOCUMENTS

| | | | |
|---|---|---|---|
| 82348 | 11/1956 | Denmark | 337/415 |

*Primary Examiner*—Harold Broome

*Attorney, Agent, or Firm*—Keith D. Beecher

[57] ABSTRACT

A heat sensing cable is provided for use in an alarm and/or fire extinguishing system, which is capable of responding to the presence of fire, or excessive heat, and to sound an alarm, actuate fire extinguishing sprinkling equipment, operate other fire extinguishing means, or to perform other emergency functions. The heat sensing cable of the invention comprises two or more multi-strand single conductor plastic coated insulated wires twisted together in a spiral manner, and which are placed under tension when in use. Each insulated wire in the multi-conductor heat sensing cable of the invention consists of a single multi-strand conductor of low electrical resistance, formed of copper or other suitable conductive material, and having any particular gage to suit any particular application. The conductor of each insulated wire is coated with a prescribed thickness of selected thermal-responsive plastic material which softens at a predetermined temperature and which, due to its softening, causes the wire conductor in each single conductor cable of like insulation to cut through the plastic and make contact with the conductor or conductors of the other cable having similar insulated wire or wires, when their predetermined temperture is reached. The resulting bare conductors are caused to twist together tightly, making a firm and positive electrical contact.

4 Claims, 8 Drawing Figures

MULTI-STAGE HEAT SENSING CABLE AND EMERGENCY COMMUNICATION SYSTEM

BACKGROUND OF THE INVENTION

The heat sensing cable of the present invention is of the same general type as described in prior U.S. Pat. Nos. 3,257,530; 3,701,985; and 3,950,746, all of which issued in the name of the present inventor. The heat sensing cable of the invention, similar to the cable described in the aforesaid patents, is intended to be used either indoors or outdoors and in conjunction with homes, or large or small industrial facilities, underground as in mines, in the frozen North, or in the hottest deserts. The heat sensing cable of the invention has the advantage of being unaffected by extremes in weather conditions. The cable may also be used in all types of environmental-contaminated areas without affecting its long life and efficient operation.

The cable of the invention is primarily intended to function as a single or multi-stage heat sensing device. However, as will be described, it can also be used to perform additional functions while still performing its primary functions. These additional functions may include, for example, anti-intrusion and break-in warnings, monitoring unattended equipment, signalling emergency calls, and voice communication either when used as an antenna for radio communication in underground installations or by the use of one of the multi-cables for above-ground use, all these additional functions being performed without in any way affecting its primary function as a multi-stage heat sensing device. In addition, the heat sensing cable of the invention is capable of providing for the detection and location of a broken span at any point along its length.

As mentioned briefly above, the heat sensing cable of the invention may be constructed to provide a sequence of alarms. Specifically, the cable may detect fire in a very early stage by the inclusion of smoke or products of combustion detectors at any point along its length, connected to specific wires of the multi-conductor cable. This early warning may be used to sound only a local alarm to permit local personnel to take immediate action, and thus prevent that alarm from being transmitted to the central fire station if the fire is small enough to be extinguished locally. A second alarm will sound directly into the Fire Station if the fire is unchecked and the temperature should reach 125° F. or 155° F. Likewise, as also mentioned, if the fire should still persist, and get out of control, the cable will initiate a third alarm when the temperature reaches a higher level such as in the range, for example, of 175° F.–225° F., and this alarm is also transmitted to the local fire station, where the signals would be identified and their exact location would be indicated, so that appropriate action could be taken.

The various combinations of cables of the invention are installed in continuous spans of any desired length to suit any particular application, and each span is placed under tension by appropriate means, which will be described subsequently. The spans, for example, may extend five feet to 500 feet, or more. A single circuit of the cable may be, for example, up to 20 miles long. Normal spans in warehouses and most installations would be tensioned by use of a tension spring or springs, to supply the desired tension, whereas, in underground installations the Tension Arm, as described in U.S. Pat. No. 3,950,746 would be used; and for outdoor use where it is desired to use very long spans and expansion and contraction due to ambient temperature ranges may change the length of the cable, also the length of the cable will vary due to the wind causing the cable to bow, in this case weights and pulleys must be used to keep the span under constant tension.

An important feature of the heat sensing cable of the present invention, and an advantage of the present cable over the prior art types, is that it requires only one manufacturing operation, and this is the extrusion of a single conductor plastic-covered cable. Two or three or more types of single conductor cables may be readily manufactured, each having varying gauges of conductors and varying ranges of thermal-responsive plastic insulating material, depending on the requirements. The finished cable may then be wound from single-conductor cable reels into a two-conductor, three-conductor, etc. cable, with the individual cables having either the same thermal-responsive plastic insulating material, or a combination of two or more types of thermal-responsive plastic insulating materials.

Polarity indicia of the conductors, and appropriate identification markings, may be applied at the time of twisting the single-conductor cables into the multi-conductor heat-sensing cable. The multi-conductor heat-sensing cable may include, for example, one or two conductors coated with Teflon, or other suitable non-thermal-responsive high temperature resistant insulating material, and wound either in the same direction as the thermal-responsive conductors, or in the opposite direction. The non-thermal-responsive conductors may be used for communication purposes, and its insulation is intended to withstand as high temperatures as possible, to enable its use after the other thermal-responsive cables have shorted together due to the heat of the fire.

An advantage of the heat-sensitive cable of the present invention is that it may be produced more simply and economically than the prior art heat-sensitive cable, and in that it is better subject to quality control. Also, large stocks of the various required types of the multi-conductor heat-sensitive cables of the invention are not necessary, since the single-conductor cables may be stocked, and wound together into various combinations, as the particular needs arise. For example, for most purposes, only three types of single-conductor thermal-responsive cable need be stocked, representing, for example, a low temperature range insulation, a medium temperature range insulation, and a high temperature range insulation. One or two non-thermal-responsive cables could be included and used, for example, voice communication. A summary of the combination of such a multi-conductor cable and its uses might be as follows:

| No. of Conductors | Single Conductor Cable Low Range | Med. Range | High Range | SERVICE Teflon | Fire | Emerg. | Voice | Operation Heat Range |
|---|---|---|---|---|---|---|---|---|
| 2 | 2 | — | — | — | ✓ | — | — | Low |
| 2 | — | 2 | — | — | ✓ | — | — | Med. |

-continued

| No. of Conductors | Single Conductor Cable Low Range | Med. Range | High Range | SERVICE Teflon | Fire | Emerg. | Voice | Operation Heat Range |
|---|---|---|---|---|---|---|---|---|
| 2 | — | — | 2 | — | ✓ | — | — | High |
| 3 | 2 | — | — | 1 | ✓ | — | ✓ | Low |
| 3 | — | 2 | — | 1 | ✓ | — | ✓ | Med. |
| 3 | 2 | 1 | — | — | 2 stage | ✓ | — | Low, Med. |
| 3 | — | 2 | 1 | — | 2 stage | ✓ | — | Med. High |
| 3 | — | — | 2 | 1 | ✓ | — | ✓ | High |
| 4 | 2 | 1 | 1 | — | 3 stage | ✓ | — | Low, Med. High |
| 4 | 2 | 1 | — | 1 | 2 stage | ✓ | ✓ | Low, Med. |
| 4 | — | 2 | 1 | 1 | 2 stage | ✓ | ✓ | Med. High |
| 4 | 2 | — | — | 2 | ✓ | — | ✓ | Low |
| 5 | 2 | 1 | 1 | 1 | 3 stage | ✓ | ✓ | Low, Med. High |
| 6 | 2 | 1 | 1 | 2 | 3 stage | ✓ | ✓ | Low, Med. High |

DETAILED DESCRIPTION OF THE ILLUSTRATED EMBODIMENTS

Figure 1:
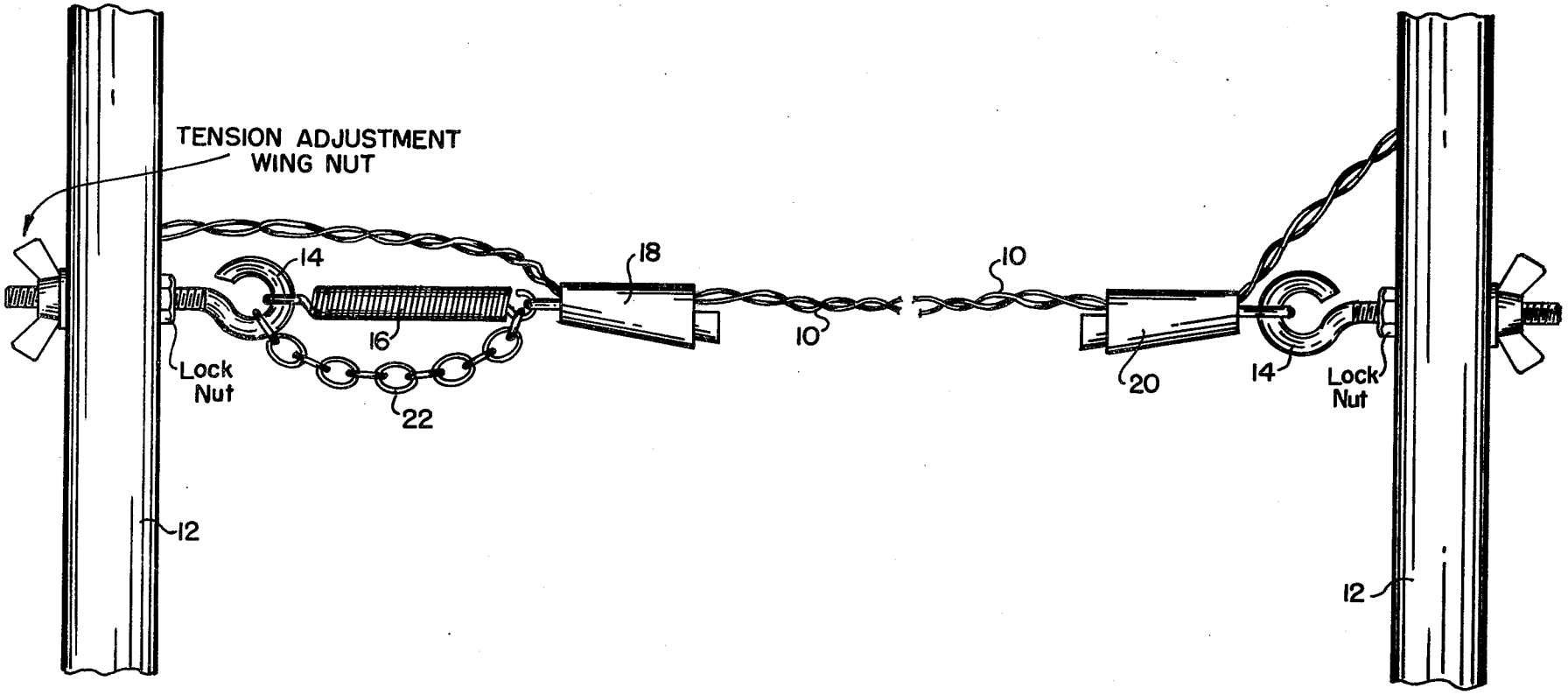
FIG. 1 shows a normal length span of a heat-sensing cable supported in tension by a spring or springs between a pair of anchor means, which heat sensing cable may be constructed in accordance with the concepts of the present invention.

In the illustration of FIG. 1, the heat sensing cable 10 is shown supported in tension between two anchor means 14 by the use of a single tension spring 16 at one end of the spanned cable 10. However, the spanned cable 10 may be tensioned by the use of a tension spring 16 at each end of the span 10. The span 10 is connected to the tension spring or springs 16 by means of a cable clamp 18 or 20, which, in the case of a single tension spring, the cable clamp 20 is connected directly to the anchor means 14 which is adjustable by a wing nut and lock nut. An overload chain 22 is provided to prevent over stressing of the spring.

Figure 1A:
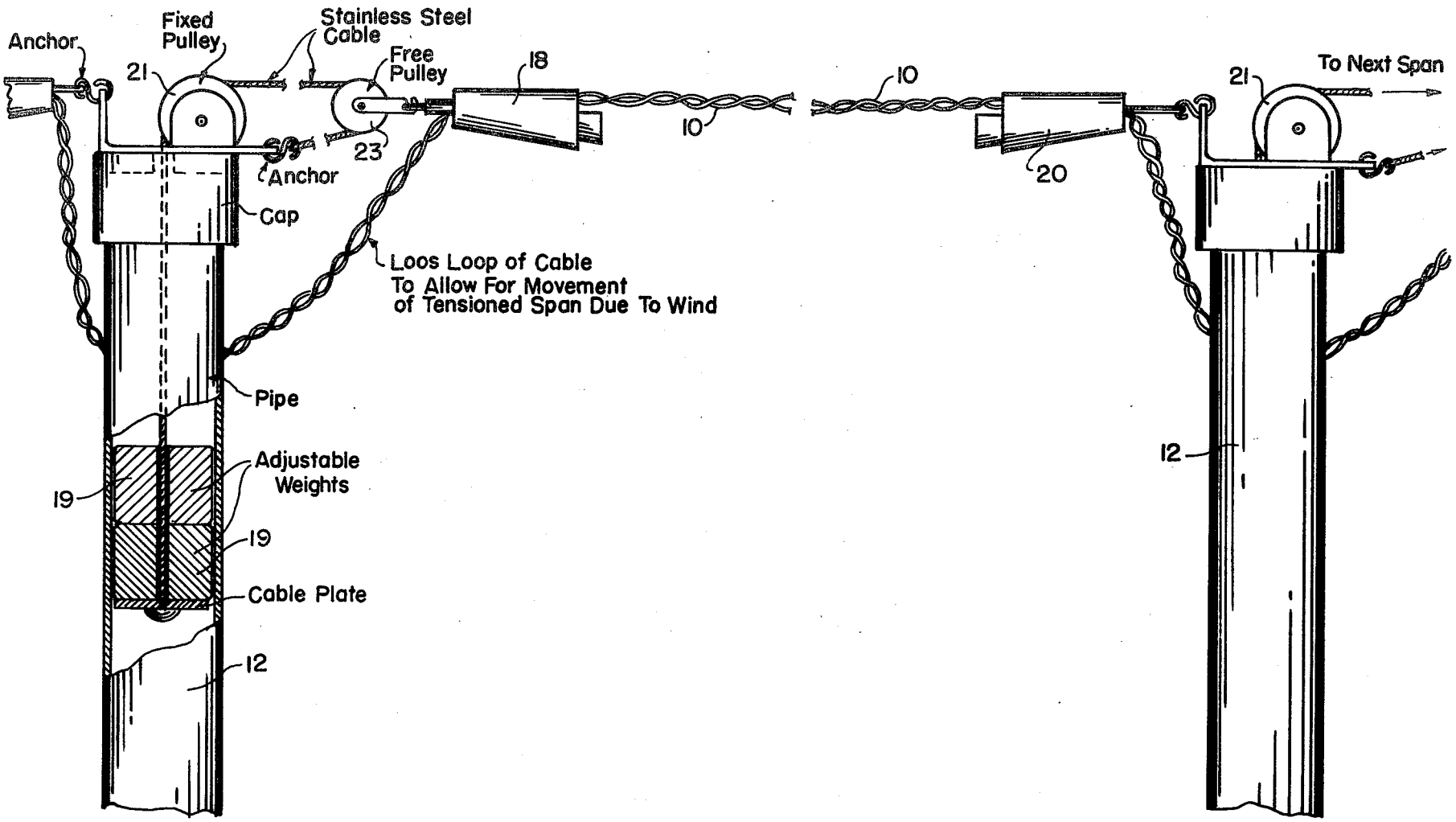
FIG. 1A shows a long length span for outdoor installation supported in tension between a pair of anchor means with tension provided by use of weights and pulleys.

In the illustration of FIG. 1A, long spans (over 200 ft.) must be tensioned by the use of weights 19 and pulleys 21 and 23 at one end of each span, as shown in FIG. 1A, to maintain the span under constant tension to allow for change in length of the long spans 10 due to expansion and contraction by changes in ambient temperature; also due to the excessive increase in length during high winds when the span will bow considerably and could over stress springs or break the heat-sensing cable span 10 if it is unable to move freely. In all cases of brush fires, the fire is usually driven by excessively high winds to which the heat-sensing cable would be subjected at this critical time. As one of the primary uses of this cable is for installation outdoors, it must be protected from breakage during high windstorms, and with the use of weights as shown in FIG. 1A, the cable can withstand windstorms up to 100 mph or more.

The length of the span will change with changes in the ambient temperature and a high wind will easily over-stretch springs or other limiting expansion tensioning devices and cause the cable to break. Since, as explained in the specification, the very time when the cable is needed to operate will be during brush fires, at which time a high wind invariably exists, the span cannot be tensioned in any other way so as to permit sustained and controlled tension of the cable under these conditions, both due to the increased ambient temperature at which time the span would lengthen and the tension would therefore decrease (as during hot weather and brush fire conditions); and during high winds when the stress would increase considerably and cause the cable to break, again as would exist during brush fires. Without this means of controlled tensioning of the span, the cable cannot be expected to operate properly.

The heat-sensing cable 10 is mounted in tension in the system shown in FIGS. 1 and 1A. Should a fire occur, so that the temperature of the heat-sensing cable 10 rises to a particular temperature range, the insulation of the various conductors making up the cable softens, and the tension of the span causes the conductors of the individual cables to rupture the softened plastic insulation and the resulting bare conductors to twist together into a tight and positive electrical contact.

Figure 2:
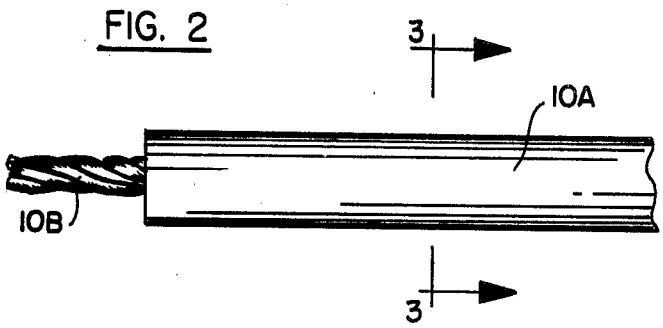
FIG. 2 is a side view of a length of single-conductor heat-sensing cable for use in the multi-conductor cable of the invention.
Figure 3:
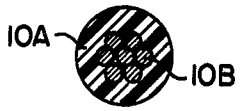
FIG. 3 is a cross-section of the heat-sensing cable of FIG. 2 taken along the line 3—3 of FIG. 2.

In accordance with the present invention, the heat-sensing cable 10 is made up of two or more individually insulated conductors of the type designated 10A in FIG. 2. Each individual conductor includes preferably a multi-stranded wire composed, for example, of copper, and designated 10B in FIG. 3. The cable 10C of FIG. 4 is a two-conductor cable, and it is made up of two conductors of the type shown in FIG. 2, each having the same plastic insulation, and twisted together as shown.

Figure 4:
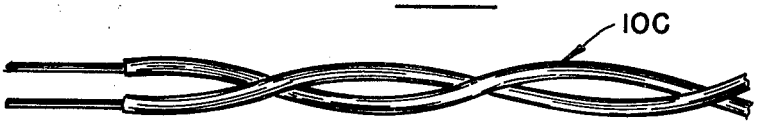
FIG. 4 is a dual-conductor heat-sensing cable in accordance with one embodiment of the invention.

The two-conductor cable of FIG. 4 is formed of two single plastic-coated conductors of the same type, the insulated conductors being wound together at a prescribed number of twists per foot of cable. The resulting dual-conductor cable may be treated with a coating of cement to hold the individual insulated conductors together. When the cable 10C of FIG. 4 is placed in spans and under tension, as shown in FIG. 1 or 1A, the cable will detect heat of fire originating anywhere along its length, and will cause the multi-stranded wires in the individual conductors to rupture their plastic insulation when the temperature around the cable reaches a predetermined level. When that level is reached, and as described above, the conductors short-circuit together, and the location of the fire can be determined to its exact location along the circuit to the point of short-circuit by an appropriate electrical locator system.

The action of the cable 10C of FIG. 4 in detecting a fire is caused by the softening of the selected fire-resistant thermal-responsive plastic used as the insulation of the individual conductors, and the tension in the span. The two conductors are therefore held out of contact until the plastic softens, at which time the wires rupture the plastic insulation and come together in a state of equilibrium in a tightly twisted physical contact, making positive electrical contact without the presence of any molten, melted or carbonned plastic preventing positive electrical conductance when the plastic first softens, and before the plastic melts or burns.

Figure 5:
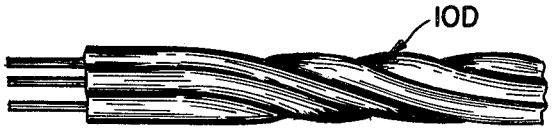
FIG. 5 is a three-conductor heat-sensing cable in accordance with a second embodiment.

A three-conductors cable is designated 10D in FIG. 5. In the three-conductor cable, all three conductors may have the same type of insulation, or two of the conductors may have low temperature insulation, and one may have medium temperature insulation. The three separately insulated conductors are wound together, as shown in FIG. 5, with a coating of cement to hold the conductors together at a prescribed number of twists per foot of cable, so as to form the three conductor cable. Each single conductor cable may first be marked to identify the polarity of the conductors, and their type of thermal-responsive plastic.

The three-conductor cable of FIG. 5, when placed in spans and under tension in a system such as shown in FIGS. 1 and 1A, may be used to detect the heat of a fire at any point along its length, and to provide warning signals at two stages of intensity of the fire, as described above, depending upon the extent of temperature increase. The third wire of this three-wire cable may also be used for signalling intrusion, monitoring of unattended equipment, or signalling emergency calls from any point along the circuit to a central station at the end of the line, or if desired, to any intermediate station along the circuit.

The action of the three-conductor cable 10D of FIG. 5 is similar to that of the two-conductor cable 10C of FIG. 4. When the three-conductor cable 10D is placed in spans and under tension, such as shown in FIGS. 1 and 1A, the heat of fire at any point along its length will soften the plastic insulation. This causes the stranded wires of all three-conductors to rupture through the softened plastic and come together in a state of equilibrium, and to be tightly wound together in positive electrical contact (assuming that the plastic insulation of all three conductors is the same). This action causes a dual alarm to sound, as both the fire circuit conductors make contact with each other, and also the third conductor which is normally used as emergency or intrusion warning contacts the other two conductors, thus both the fire alarm and the emergency alarm sounds.

Figure 6:
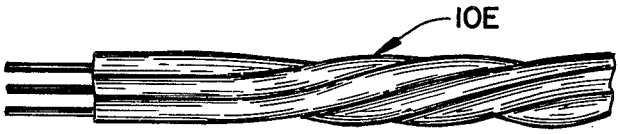
FIG. 6 is a three-conductor heat-sensing cable in accordance with a third embodiment.

The three-conductor cable 10D of FIG. 6 is one in which two of the conductors have a low range thermal-responsive insulation, and one of the conductors has a high range thermal-responsive insulation. In the latter cable, two of the conductors will come together at a relatively low temperature to sound, for example, a local alarm; and the wires of the third conductor will come into contact with the wires of the other two conductors at a higher temperature, to sound, for example, an alarm in the central fire station.

In precisely the same manner as the three-conductor cable shown in FIG. 6, four single thermal-responsive plastic-insulated conductors may be wound together with two conductors being insulated with a low-range thermal-responsive plastic, and the other two conductors having respectively a medium-range thermal-responsive plastic insulation and the other a high-range thermal-responsive insulation. Thus a fire will produce three alarms at three different temperature. Likewise, four single plastic-coated conductors can be wound together such as in the case of the cable 10F of FIG. 7, the resulting cable and its action is exactly the same as the three-conductor cables described above. However, in this case, the fourth plastic-coated single conductor is not made of a thermal-responsive plastic but of a plastic which will resist heat by having a much higher melting or softening point, such as Teflon. The wire gauge and the outer diameter of the single Teflon-insulated conductor will be the same as that used to form the other three single thermal-responsive insulated conductors. However, in this case, the fourth Teflon-coated conductor can be wound either in the same direction and the same number of twists per foot as the other three conductors, or in the opposite direction to the other three heat-sensing plastic-insulated conductors at a somewhat less number of twists per foot of cable. When the Teflon-coated conductor is wound in the opposite direction, and is twisted at a lesser number of twists per foot of finished cable, it is therefore not under tension. That is, only the three thermal-responsive plastic insulated conductors will be placed under tension. As before, the four-conductor cable may have a coating of cement to hold the individual insulated conductors together at the prescribed number of twists per foot.

Figure 7:
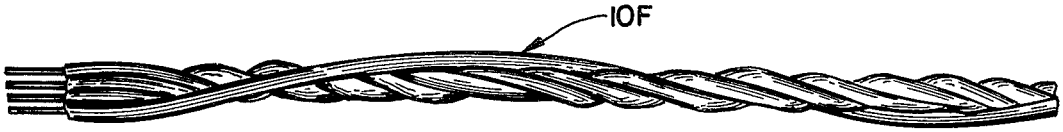
FIG. 7 is a four-conductor heat sensing cable in accordance with a fourth embodiment.

The action of the four-conductor cable 10F of FIG. 7 will, in principle, be similar to that of the three-conductor cable 10D or 10E of FIG. 5 or 6, with the exception of the action of the fourth conductor. When the four-conductor cable 10F is affected by heat above the threshold of the softening point of the plastic used in the three thermal-responsive heat-sensing cables, their conductors will rupture the plastic in the manner previously described according to their type and softening point. However, the twisting or turning of the cable during rupturing and heating of the heat sensing conductors causes the Teflon-coated conductor, when wound in the opposite direction to the heat-sensitive conductors, to rotate in the opposite direction and therefore untwist from the cable. This action causes the Teflon-coated conductor to lengthen and become loose at or adjacent to the point of heating.

The fourth Teflon-insulated conductor of the cable 10F is used as a communication link, and it will permit, for example, telephone plug-in boxes to be placed at various points along the circuit to permit the plugging in of hand-operated self-powered telephones so as to provide voice communication by personnel from one point to another along the circuit. Also, watchman-clock stations may be located at various points along the circuit. In addition, heat sensing spot detectors, such as described in U.S. Pat. No. 3,701,985 may be connected to the fourth conductor.

It is to be understood, of course, that the heat sensing cable of the invention is not limited to any particular number of individual conductors, and as many can be used as any installation requires.

The selected thermal-responsive plastic materials are fire-resistant and do not support combustion. The thickness of the plastic over the wire conductors of the individual single conductor cables can be varied, as can the conductor gauge, so as to produce a desired rate of response. The single insulated conductor, as drawn and extruded by the cable manufacturer, has no function as a fire sensor when used by itself. The present invention is concerned with the concept of twisting such single-conductor cables together, either with the same or different insulating materials, so as to achieve the results discussed above.

In each instance, the method of winding the various types of single conductor heat sensing cables together may be the same, but may vary only by the number of twists per foot of cable length, depending upon the number of single plastic-coated conductors being wound together, to produce a multi-conductor cable to operate, for example, at different rates of temperature rise.

As described above, the individual insulated conductors may be cemented to one another in the heat-sensing cable of the invention to hold them in their twisted condition. Alternately, the individual twisted insulated conductors may be enclosed inside a thin plastic protective sheath which is capable of easily and quickly conducting heat to the thermal-responsive cables enclosed therein.

The invention provides, therefore, a multi-conductor heat sensing cable which is formed of a plurality of single insulated conductors, each of which may be manufactured by standard manufacturing extrusion techniques, so that the heat sensing cable of the invention is simple in its construction and low in cost. A preferred embodiment includes a plurality of individual insulated conductors each being formed of solid or stranded-type copper wires, covered with selected thermal-responsive plastic materials which have various desired softening points.

It will be appreciated that while particular embodiments of the invention have been shown and described, modifications may be made. It is intended in the claims to cover the modifications which come within the spirit and scope of the invention.

What is claimed is:

1. A heat-sensing cable to be supported in tension as at least one span between a plurality of anchoring means, said cable including a plurality of separate insulated electrical conductors, each of said electrical conductors including stranded electrical wires insulated by a sheath of thermal-responsive plastic material selected to soften when a particular temperature threshold is reached, said separate electrical conductors being twisted together so that when the heat sensing cable is mounted under tension and when the particular temperature threshold is reached the electrical wires of the individual conductors will rupture the sheath and twist together in positive electric contact, and in which said heat-sensing cable includes at least three separate insulated electrical conductors, and in which two of said insulated electrical conductors have sheaths of thermal-responsive plastic material selected to soften at the same temperature threshold, and in which one of said separate insulated electrical conductors has a sheath of thermal-responsive plastic material selected to soften at a temperature threshold higher than the temperature threshold of the other two conductors.

2. A heat-sensing cable to be supported in tension as at least one span between a plurality of anchoring means, said cable including a plurality of separate insulated electrical conductors, each of said electrical conductors including stranded electric wires insulated by a sheath of thermal-responsive plastic material selected to soften when a particular temperature threshold is reached, said separate electrical conductors being twisted together so that when the heat-sensing cable is mounted under tension and when the particular temperature threshold is reached the electrical wires of the individual conductors will rupture the sheath and twist together in positive electrical contact, in which the heat-sensing cable includes a further separate electrical conductor having an insulated sheath selected to withstand temperatures in excess of said particular temperature threshold.

3. The heat-sensing cable defined in claim 2, in which said further electrical conductor is wound in the opposite direction to said plurality of separate insulated electrical conductors.

4. A heat-sensing cable to be supported in tension as at least one span between a plurality of anchoring means, said cable including a plurality of separate insulated electrical conductors, each of said electrical conductors including stranded electrical wires insulated by a sheath of thermal-responsive plastic material selected to soften when a particular temperature threshold is reached, said separate insulated electrical conductors being twisted together so that when the heat-sensing cable is mounted under tension and when the particular temperature threshold is reached the electrical wires of the individual conductors will rupture the sheath and twist together in positive electric contact, in which said heat-sensing cable includes at least four separate insulated electrical conductors, and in which two of said insulated electrical conductors have sheaths of thermal-responsive plastic material selected to soften at the same temperature threshold, and in which a third of said separate insulated electrical conductors has a sheath of thermal-responsive plastic material selected to soften at a temperature threshold higher than the temperature threshold of the other two conductors, and in which a fourth of said separate insulated electrical conductors has a sheath of thermal-responsive plastic material selected to soften at a temperature threshold higher than the temperature threshold of the sheath of the third conductors.

* * * * *